US005158146A

United States Patent [19]

Fuller

[11] Patent Number: 5,158,146

[45] Date of Patent: Oct. 27, 1992

[54] MOBILE FOXHOLE EXCAVATOR

[76] Inventor: Frank E. Fuller, 16224 N. 21st St., Phoenix, Ariz. 85022

[21] Appl. No.: 666,708

[22] Filed: Mar. 8, 1991

[51] Int. Cl.[5] ..... E21B 7/02; E21B 10/26; E21C 11/02; E06C 1/38

[52] U.S. Cl. ..... 175/122; 173/28; 175/203; 182/127; 182/159

[58] Field of Search ..... 175/203, 162, 122, 388; 173/22, 23, 28; 182/159, 160, 100

[56] References Cited

U.S. PATENT DOCUMENTS

| | | | |
|---|---|---|---|
| 2,594,098 | 4/1952 | Vanderzee . | |
| 2,734,722 | 2/1956 | Pokorny . | |
| 2,807,441 | 9/1957 | Sewell . | |
| 2,812,162 | 11/1957 | Lay . | |
| 2,904,310 | 9/1959 | Leonard . | |
| 2,959,398 | 11/1960 | Troche . | |
| 3,017,935 | 1/1962 | Galbraith | 175/123 |
| 3,044,562 | 7/1962 | Crampton | 175/201 |
| 3,149,680 | 9/1964 | Downend | 173/39 |
| 3,396,814 | 8/1968 | Garnett | 182/2 |
| 3,406,768 | 10/1968 | Miller | 175/162 |
| 3,438,450 | 4/1969 | Failing | 173/44 M |
| 3,525,404 | 8/1970 | Newman et al. | 173/28 X |
| 3,563,320 | 2/1971 | Von Ruden | 173/27 |
| 3,696,625 | 10/1972 | Alexander | 173/46 |
| 3,917,005 | 11/1975 | Cannon et al. | 173/23 |
| 3,989,122 | 11/1976 | Jenkins | 182/159 X |
| 4,050,526 | 9/1977 | Deike | 173/27 |
| 4,068,728 | 1/1978 | Subrick | 173/27 |
| 4,132,288 | 1/1979 | Bingham | 182/100 X |
| 4,195,698 | 4/1980 | Nakagawasai | 173/44 |
| 4,199,033 | 4/1980 | Van Gundy, Jr. | 173/27 |
| 4,371,056 | 2/1983 | Anglade | 182/159 X |
| 4,627,499 | 12/1986 | Magee et al. | 173/43 |

*Primary Examiner*—Stephen J. Novosad
*Attorney, Agent, or Firm*—LaValle D. Ptak

[57] ABSTRACT

A mobile foxhole excavator (MFE) is mounted on a standard military vehicle for transport and positioning. The excavator is powered by a self-contained internal combustion engine, which powers a hydraulic system for positioning an auger mast in three mutually perpendicular planes (horizontal, vertical and lateral) to permit the auger to bore holes at any desired angle between vertical, downward, and horizontal, as well as boring at various overhead angles between horizontal and near vertical. A single hydraulic motor is used to operate the boring auger, as well as various hydraulic cylinders to effect the desired positioning of the auger mast.

11 Claims, 5 Drawing Sheets

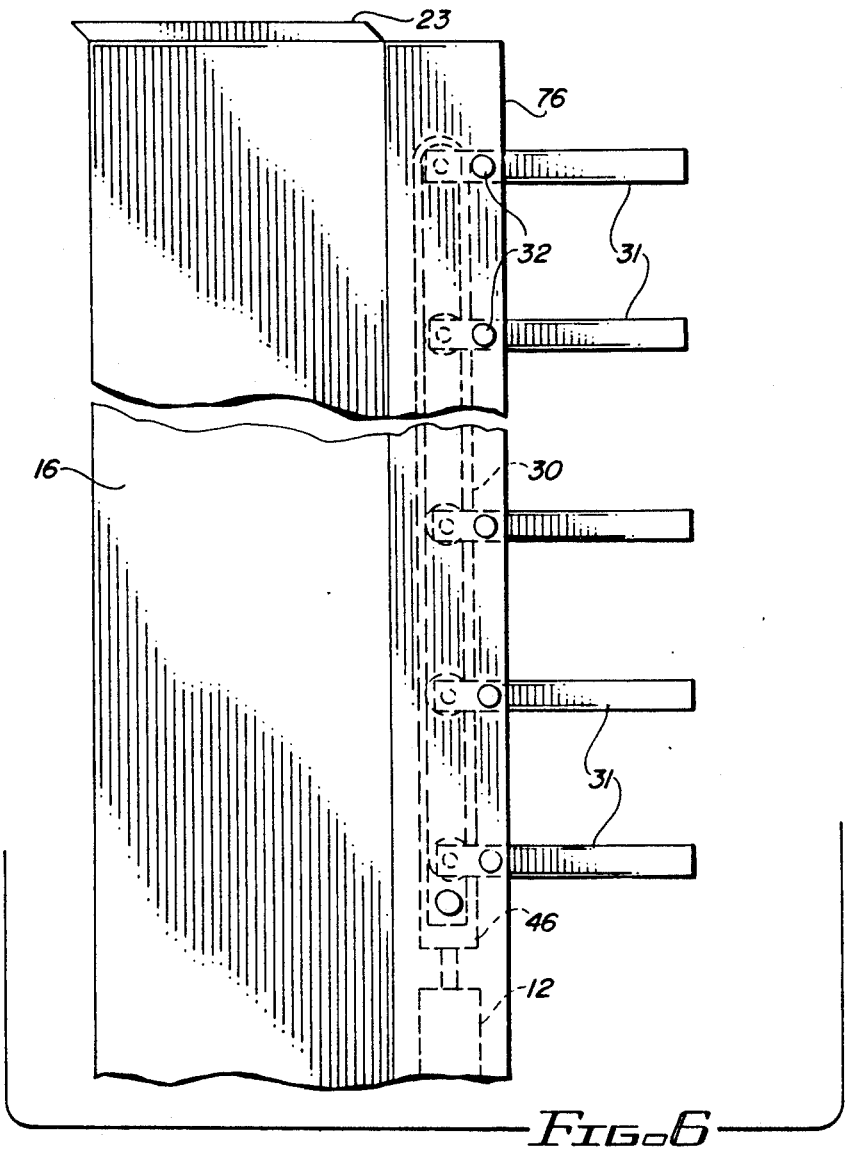
FIG. 6
FIG. 5
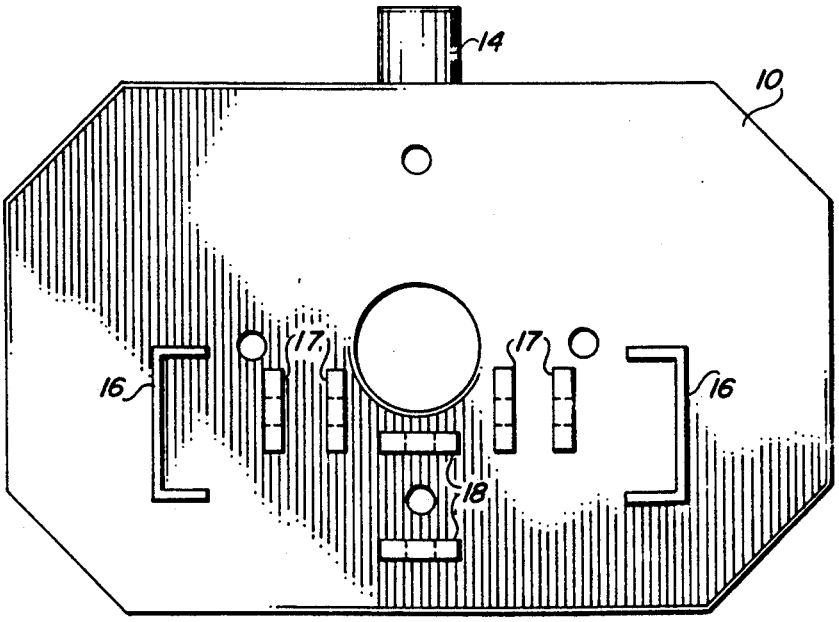

MOBILE FOXHOLE EXCAVATOR

BACKGROUND OF THE INVENTION

At present there is no effective method that can be used to quickly and efficiently construct defensive perimeters under battle conditions. The current method of digging protective foxholes requires the individual combat soldier to use a pick and shovel or a shovel only. This method is painfully slow and although extremely difficult when digging in normal density soils, it is almost impossible to accomplish with any measure of safety, when an attempt is made to dig in hardpan. The Mobile Foxhole Excavator has been designed to efficiently and speedily establish defensive combat perimeters. This equipment maintains the same mobility as the vehicle on which it is mounted and in addition to the tremendous advantage of speed in performing its excavating job, it releases highly trained specialists to perform their vital assignments. This invention will significantly reduce battle casualties by adding the explosion containment shaft, materially improving the normal foxhole protection.

SUMMARY OF THE INVENTION

This invention is a mobile foxhole excavator for use in battle defense construction and is also a general purpose earth boring apparatus. It is consists of a mast structure containing an earth boring auger and various positioning and adjusting means. It is designed to be installed on an all-terrain transporting and positioning vehicle that is standard armed forces equipment, such as an all-wheel drive or tracked vehicle. It can easily bore foxholes in virtually any soil including hardpan surfaces, subsoil containing rocks and gravel, loose dirt, and sand. It produces uniform foxholes for perimeter defense at a rate infinitely faster than personnel using hand tools.

It can also bore holes as needed for material storage, garbage dumps, latrines, tank traps, mines, explosive charges, footings for bunkers, planting posts and poles, etc., using special augers, the Excavator can bore holes in asphalt, concrete, rock and wood for purposes of construction, demolition, repair or any other purpose.

The positioning and adjusting actuators make the auger mast into an extremely versatile boring arm, capable of reaching outward from its supporting vehicle and boring holes at any angle from vertically downward up to the horizontal and at any overhead angle up to the near-vertical. It can also reach across barriers of moderate height and bore holes on the side opposite that on which the vehicle is located.

These characteristics give the MFE the capability of boring holes in difficult locations and hard-to-reach spaces, as may be required, given a particular set of circumstances. In addition they render the machine capable of shrinking its size to permit passage through narrow or restricted areas.

In operation, a driver positions the transport vehicle in a convenient position at the desired location of the hole to be bored. The operator sits at a control console to position and adjust the auger mast for drilling; the mast is set at the required angle and ground contact position and the hole is bored to the desired depth. The auger mast is then retracted for ground clearance and the driver moves the transport vehicle to the desired position for the next hole. In the new position, the operator makes any required adjustments in the auger mast position and angle, and the new hole is bored.

The principal object of this invention is to provide an efficient and time saving apparatus for excavating foxholes mechanically rather than by hand under combat conditions and to reduce reduce casualties. This is accomplished by means of several inter-related and connected mechanical and hydraulic devices embodied in a machine which bores foxholes to establish defense perimeters in a very timely manner. It also frees personnel from manual digging operations to do other expedient and necessary tasks such as scouting patrols, manning observation posts and securing their positions.

Another object is to provide an apparatus which permits boring holes at any angle from vertical to horizontal.

Another object is to provide an apparatus which permits boring holes at any and all overhead angles between the horizontal and the near-vertical upward direction.

Still another object is to provide a machine that can adjust its boring mast from the travel position, inclined at about 30 degrees above the horizontal, to the horizontal position in order to compact its bulk and permit movement through low clearance areas.

Another object is to provide an apparatus which can adjust its boring mast to an acceptable angle of elevation and extend it to a suitable length such that it can reach the tops of certain kinds of defensive barricades.

Another object is to provide an apparatus which has a staircase incorporated into its mast in its extended condition, over which fully equipped combat troops can run with hands free during offensive actions.

A further object of the invention is to provide a machine which can bore holes in uneven ground or on very steep slopes.

An even further object is to provide an apparatus which is capable of vertically lifting its support frame so as to permit motion up or down a slope and of boring holes at any elevation on the slope and at any desired angle into the slope.

Another object of the invention is to provide a machine to bore an explosion containment shaft into the bottom of the foxhole.

Still another object of the invention is to provide an apparatus which cuts a foxhole floor with a stepped slope leading to that shaft.

Yet another object of the invention is to provide an apparatus which bores an improved foxhole with an explosion containment shaft centered in its bottom, and a stepped slope leading to that shaft, in a one-step operation.

Another object of this invention is to provide a machine for constructing traps of various military applications such as tank and personnel traps.

BRIEF DESCRIPTION OF THE DRAWINGS

NOTE: Drawings are referenced to the operator's viewpoint and position.

FIG. 5 is a top plan view of the base plate assembly of the apparatus in FIG. 1.

FIG. 6 is a left side elevation view of the stair step mechanism in the auger mast of the FIG. 1 apparatus.

DETAILED DESCRIPTION OF THE INVENTION

Figure 1:
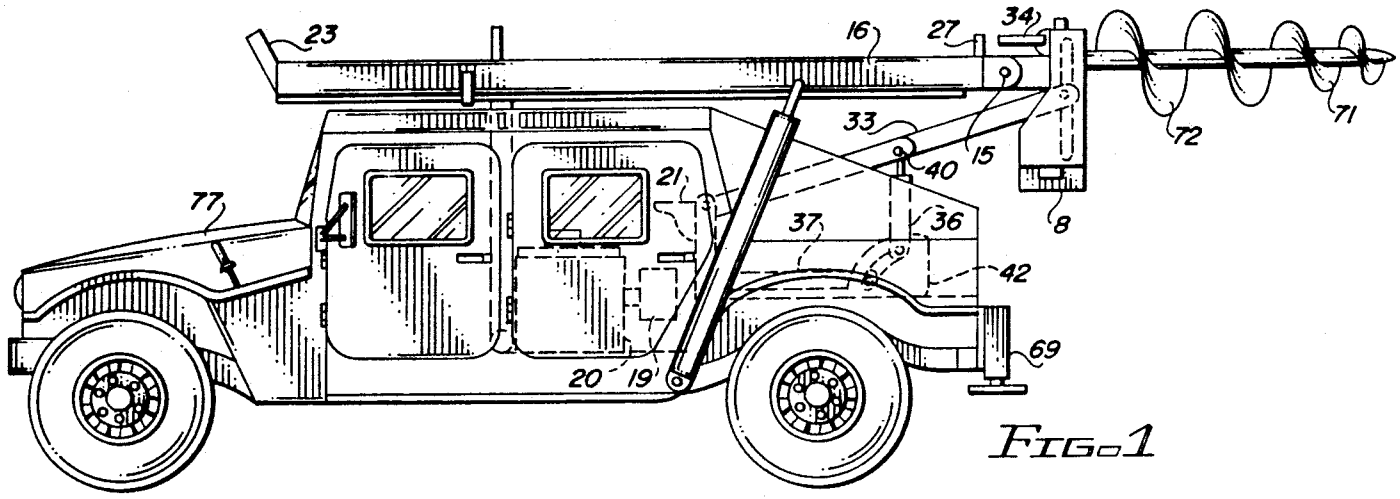
FIG. 1 is a right side elevation view of a typical mobile foxhole excavator fabricated according to the current invention and mounted on a military transport and positioning vehicle.

Referring to FIG. 1, a representative mobile foxhole excavator (FIGS. 2 and 7) fabricated per the present invention, is disclosed in compact horizontal position to accommodate restricted passage. It is illustrated mounted on a typical military vehicle 77 (FIG. 1) for transport and positioning purposes. Auger mast 16, with augers 71 and 72, lateral tilt cylinder 34, mounting bracket 27, and mast crown 23, extends over top of vehicle. Hydraulic motor 8, cylinder mounting bracket 40, vertical positioning cylinder 33, frame elevation cylinder 36, and pivot arm 15, are shown. The locations of internal combustion engine 20, hydraulic pump 19, frame alignment cylinder 37, control console 21, and crank assembly 42, are indicated.

Figure 2:
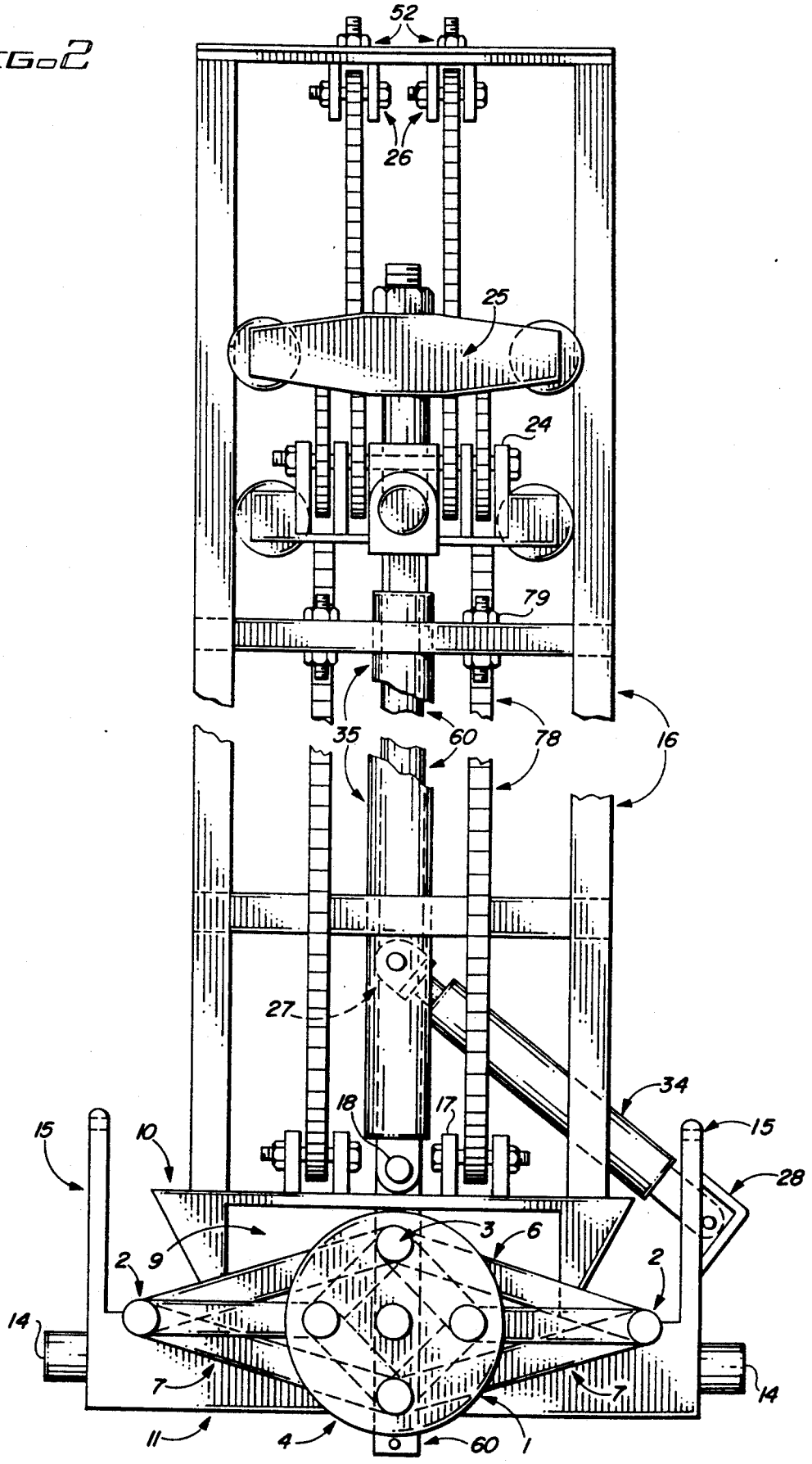
FIG. 2 is a front elevation view of the auger mast portion of the apparatus in FIG. 1.

As shown in FIG. 2, the apparatus consists of an auger mast 16, containing a drive shaft 60, mast crown 23, sprocket assembly 26, roller chain anchors 52, roller chains 78, roller chain anchors 79, vertical mast positioning arms 15, base plate pivot support assembly 14, hydraulic motor mounting plate assembly 1 with integral stress distribution support members 2, 3, 4, 5, 6 and 7, cylinder mounting brackets 18, auger mast pivot support frame 11, base plate 10, transmission 9, sprocket assembly 17, auger actuating cylinder 35, translating roller chain and sprocket crosshead assembly 24, translating drive shaft pressurizing crosshead assembly 25, cylinder mounting bracket 27, lateral tilt adjusting cylinder 34, and cylinder mounting bracket 28.

Figure 3:
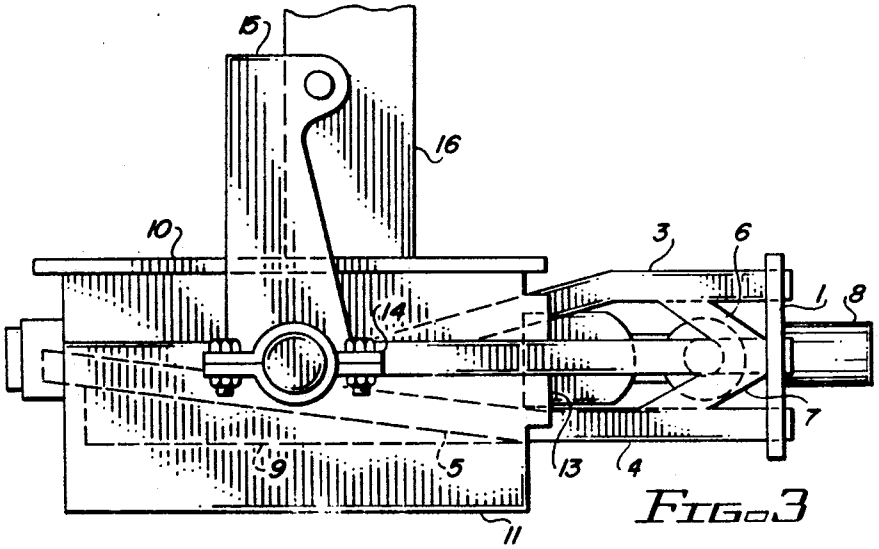
FIG. 3 is a left side elevation view of the base plate assembly of the apparatus in FIG. 1.

In FIG. 3, the base plate assembly is illustrated. The hydraulic motor 8 is attached to mounting plate 1, supported by stress distribution members 2, 3, 4, 5, 6, and 7; transmission 9 is held by transmission pivot support assembly 13; auger mast 16 is held by the auger mast pivot support frame 11; base plate 10 and transmission assembly is supported by the base plate pivot support assembly 14; auger mast 16 is raised and lowered for required positioning by auger mast vertical positioning arms 15.

Figure 4:
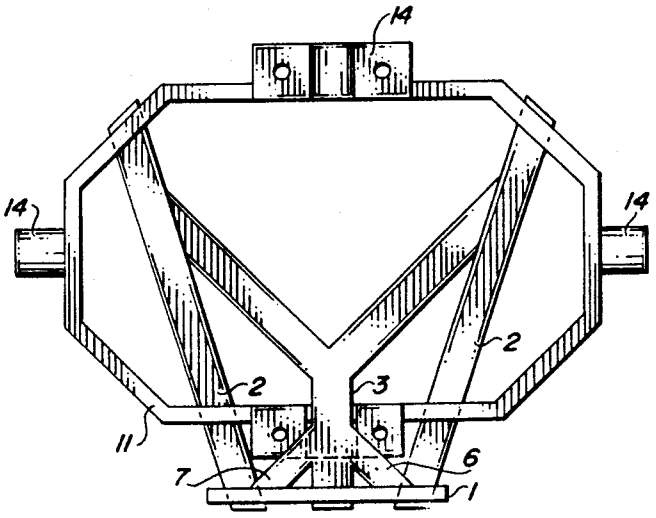
FIG. 4 is a top plan view of the pivot support for the base plate of the apparatus in FIG. 1.

A top plan view of FIG. 3, except for base plate, is shown as FIG. 4. Pivot support assembly 14, transmission pivot support assembly 13, hydraulic motor mounting plate 1, stress distribution support members 2, 3, 6 and 7, and auger mast pivot support frame 11 are shown on this drawing.

FIG. 5 illustrates the base plate 10, showing auger mast 16, sprocket assembly 17, and auger actuating cylinder mount 18.

FIG. 6 shows stair step actuating assembly, with mast crown 23, auger mast 16, staircase 76, stair step 31, stair step mounting pivot 32, stair step actuating rod 30, stair step actuating cylinder 12, and cylinder mount 46.

Figure 7:
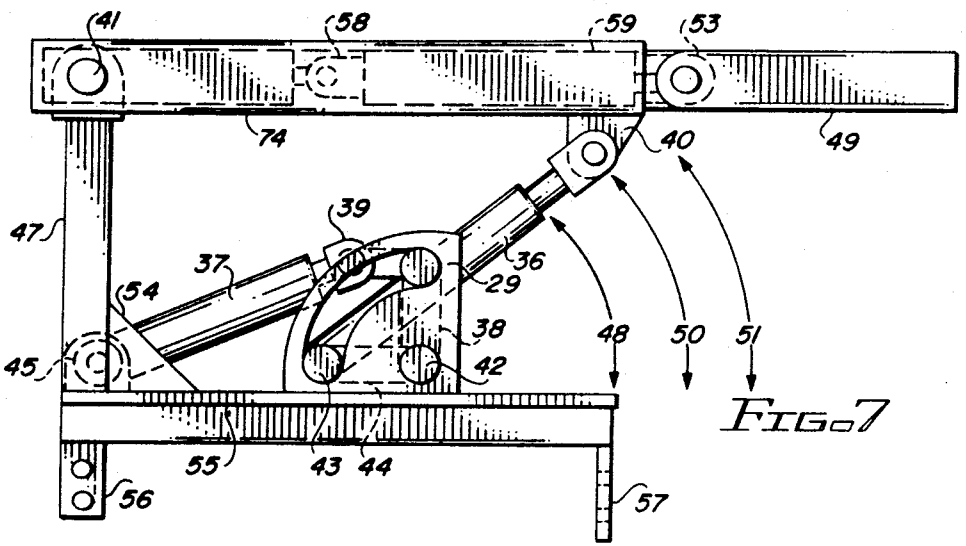
FIG. 7 is a right side elevation view of the auger mast support and positioning frame of the apparatus in FIG. 1.

FIG. 7 reveals the following details: the auger mast support and positioning frame 74, sliding frame extension 49, connected to 74 by frame extension cylinder 59, frame alignment cylinder 37, floor mount 45 for cylinder 37, pivot link 39, pivot guide plate 29, rotation links 38 and 44, rotation arcs 48, 50 and 51, crank assembly 42, elbow 43, frame elevation cylinder 36, cylinder mounting bracket 40, frame support pivot 41, frame support buttress 54, mounting floor plate 55, vehicle to floor plate mounts 56 and 57, frame cross support 53, and frame extension cylinder mount 58.

Figure 8:
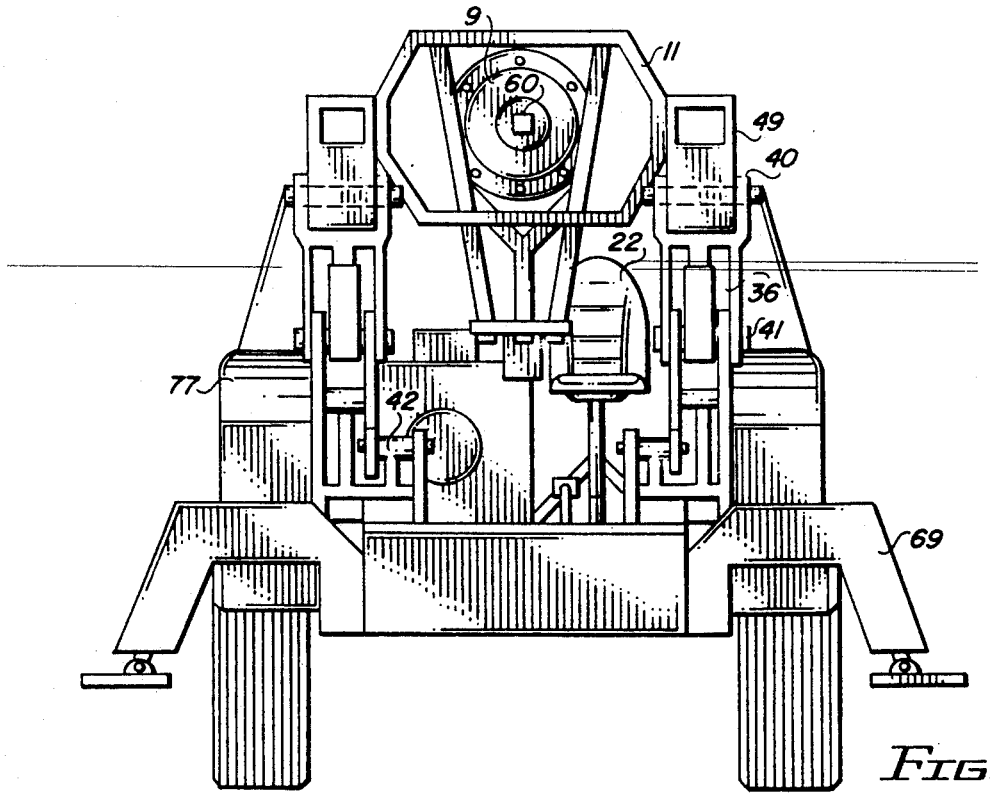
FIG. 8 is a rear elevation view of the FIG. 1 apparatus mounted on a typical military vehicle for transport and positioning.

In FIG. 8, a rear elevation view is given of the apparatus of the present invention mounted on a typical military all-wheel drive vehicle 77 for transport, positioning, and earth boring operations. Auger drive shaft 60, transmission 9, auger mast pivot support frame 11, sliding frame extension 49, cylinder mounting bracket 40, frame elevation cylinder 36, frame support pivot 41, hydraulic outrigger support 69, operator seat 22, and crank assembly 42 are shown.

Figure 9:
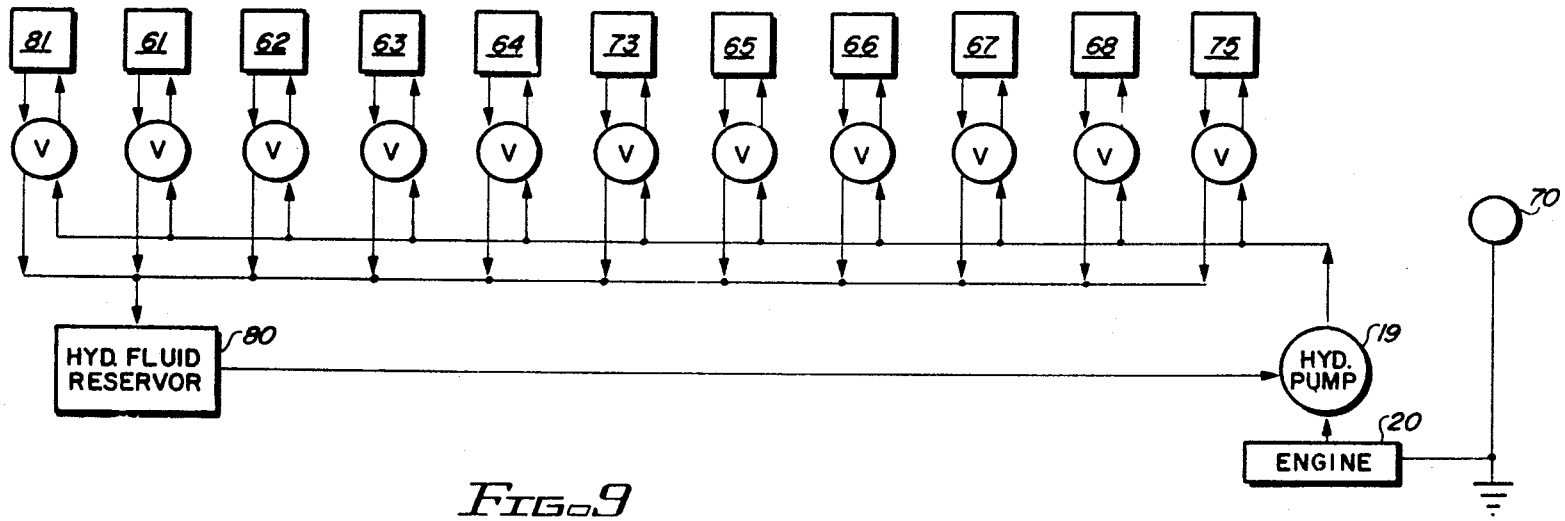
FIG. 9 is a block diagram of a typical control console and hydraulic system utilized on the apparatus of FIG. 1.

FIG. 9 is a schematic drawing of a typical control system for the present invention. Control 70 starts internal combustion engine power source 20 which drive hydraulic pump 19, supplying pressurized fluid to hydraulic reservoir 80; other controls are frame stair step control 81, left outrigger control 61, right outrigger control 62, auger control 63, hydraulic motor control 64, auger mast vertical control 65, auger mast tilt control 66, frame alignment control 67, frame extension control 68, mast stair step control 73, and frame elevation control 75.

Figure 10:
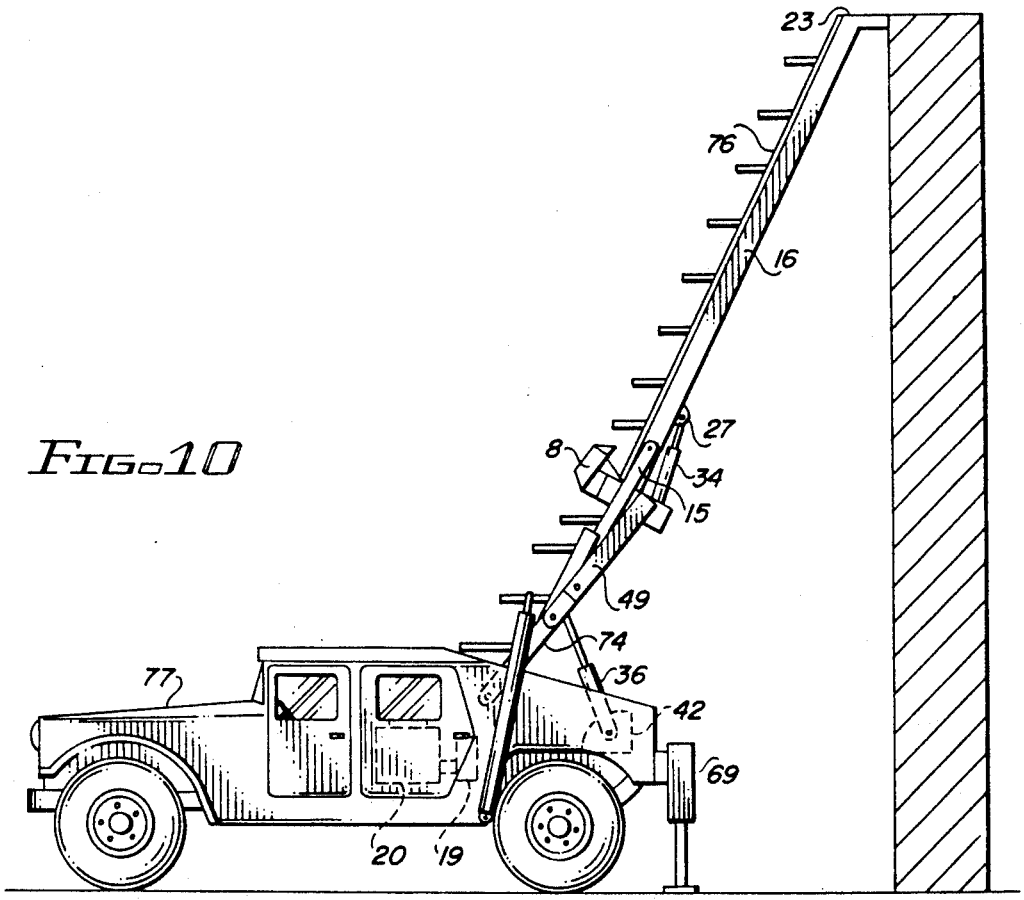
FIG. 10 is a right side elevation view of a staircase built into the auger mast of the FIG. 1 apparatus per the present invention and set up for scaling a barrier.

FIG. 10 depicts a typical MFE construction of the present invention mounted on a typical military vehicle 77, set up with staircase 76 deployed for barrier scaling. Mast crown 23, auger mast 16, cylinder mounting bracket 27, lateral tilt adjusting cylinder 34, auger mast vertical positioning arm 15, hydraulic motor 8, sliding frame extension 49, auger mast support and positioning frame 74, and frame elevation cylinder 36, are shown; and locations of internal combustion engine power source 20, hydraulic pump 19, and crank assembly 42, are indicated, all in correct relation.

OPERATING THE MOBILE FOXHOLE EXCAVATOR (MFE)

1. Boring A Vertical Downward Hole: The transport vehicle 77 (FIG. 1) positions the Mobile Foxhole Excavator on the predetermined defense perimeter layout for foxholes, or for other required hole positions, located as needed. The operator engages control 70 (FIG. 9) to start the internal combustion engine power source 20 and the hydraulic pump 19 (FIG. 1), which is direct-driven by the engine output shaft; engages the outrigger support controls 61 and 62 on control console 21 (FIG. 9), moving outrigger supports 69 (FIG. 8) into position to stabilize the transport vehicle and MFE: moves control 65 (FIG. 9) for the vertical positioning cylinders 33 (FIG. 1), engaging positioning arms 15 (FIGS. 1 and 3) for base plate pivot support assembly (FIG. 4), bringing auger mast 16 (FIGS. 1, 3, and 5) into the vertical position: engages control 63 on control panel 21 (FIG. 9) for auger actuating cylinder 35 (FIG. 2), bringing continuous downward pressure to bear on the auger drive shaft 60 (FIGS. 2 and 8) making ground contact with auger 72 (FIG. 1): engages control 64 (FIG. 9), activating hydraulic motor 8 (FIG. 1), empowering auger drive shaft 60 (FIG. 8) through transmission 9 (FIG. 2) to rotate auger 72 (FIG. 1) and bore hole to desired depth. Control 63 (FIG. 9) is reversed to retract the auger 72 (FIG. 1) from the hole to its rest position: increasing pressure on control 64 (FIG. 9) spins auger 72 (FIG. 1) at a high rotational speed and disperses the material removed from the hole in a uniform berm about the periphery of the hole. The auger is clear of the ground in its rest position and the driver moves the transport vehicle to the location of the next hole.

2. Boring An Improved Foxhole On Generally Level Ground: The transport vehicle driver positions the MFE in the predetermined defense perimeter location. The operator engages control 70 (FIG. 9) to start the internal combustion engine power source 20 (FIG. 9) which uses its output shaft to continuously drive the hydraulic pump 19 (FIG. 1). The operator next engages controls 61 and 62 on control console 21 (FIG. 9), moving outrigger supports 69 (FIG. 8) into position to stabilize the transport vehicle and MFE: operator moves control 65 (FIG. 9) for the vertical positioning cylinders 33 (FIG. 1): engaging positioning arms 15 (FIGS. 1 and 3) on base plate pivot support assembly (FIG. 4) and bringing auger mast 16 (FIGS. 1, 3, and 5) into the vertical position: activates control 67 (FIG. 9) energizing frame alignment cylinders 37 (FIGS. 1 and 7) connected to pivot 39, raising link 44 (FIG. 7) and lowering link 38 (FIG. 7) through circular arc 48 (FIG. 7). This action locks elbow 43 in the upright position and aligns the auger mast 16 (FIG. 7) with the axis of the transport vehicle 77, which on level ground is horizontal. Operator engages control 75 (FIG. 9), operating frame elevation cylinder 36, (FIG. 7), lifting frame 74 (FIG. 7) to the extent necessary for ground clearance of the two-stage auger 71 and 72 (FIG. 1): engages control 65 (FIG. 9), activating mast vertical positioning cylinders 33 (FIG. 7), bringing mast into vertical position: engages control 63 on control panel 21 (FIG. 9) for auger actuating cylinder 35 (FIG. 2), bringing continuous downward pressure to bear on augers 71 and 72 (FIG. 1) and making ground contact with auger 71: engages control 64 (FIG. 9), activating hydraulic motor 8 (FIG. 1), empowering auger drive shaft 60 (FIGS. 2 and 8) through transmission 9 (FIG. 2), rotating augers 71 and 72 (FIG. 1), thus boring an improved foxhole, which includes a centrally located explosion containment shaft (ECS), to the desired depth.

3. Boring An Improved Foxhole On A Stepped Elevation Or A Sloping Surface: The procedure for this operation is identical to that of Operation 2, above, with the following exceptions: with the transport vehicle 77 (FIG. 1) in proper location and with outriggers 69 (FIG. 8) deployed for stability of the vehicle and MFE, operator activates control 67 (FIG. 9), energizing frame alignment cylinders 37 (FIG. 7) and bringing auger mast 16 (FIG. 1) into the horizontal position: activates control 68 (FIG. 9) energizing frame extension cylinder 59 (FIG. 7), moving frame extension 49 (FIG. 7) outward to position auger mast 16 over desired position on surface. Boring operation proceeds as in operation 2, above.

4. Boring A Hole At Any Angle Between The Vertical Downward And The Horizontal: Driver positions the transport vehicle 77 (FIG. 1) in the desired location. Operator engages control 70 (FIG. 9) to start the internal combustion engine power source 20 and hydraulic pump 19 (FIG. 1): deploys outriggers 69 (FIG. 8), stabilizing vehicle and MFE: engages control 65 (FIG. 9), for vertical positioning cylinders 33 (FIG. 1): engaging vertical positioning arms 15 (FIGS. 1 and 3) on base plate support assembly (FIG. 4), bringing auger mast 16 (FIGS. 1, 3 and 5) into the vertical position: activates control 67 (FIG. 9), energizing frame alignment cylinder 37 (FIGS. 1 and 7) connected to pivot 39 (FIG. 7), rotating links 38 and 44 (FIG. 7), through part of circular arc 48, stopping auger mast 16 at the desired angle for boring. If necessary, operator engages control 68 (FIG. 9), actuating frame extension cylinder 59 (FIG. 7) and sliding frame extension 49 (FIG. 7) to place auger mast 16 precisely over the desired hole location. Then operator engages control 65 (FIG. 9), empowering auger cylinder 35 (FIGS. 2 and 8), translating auger 72, or augers 71 and 72, to the ground and exerting continuous pressure on them: engages control 64, energizing hydraulic motor 8, which turns auger power shaft 60 through transmission 9, rotating auger 72, or auger 71 and 72, and boring to the desired depth and at the desired angle.

5. Boring a Hole At Any Angle Between The Horizontal and the Near-Vertical Upward Direction: Driver positions transport vehicle 77 (FIG. 1) in the desired location. Operator engages control 70 (FIG. 9) to start the internal combustion engine power source 20 and hydraulic pump 19 (FIG. 1): deploys outriggers 69, stabilizing vehicle and MFE: engages control 67 (FIG. 9) for frame alignment cylinders 37 (FIG. 7): engaging pivot 39, rotating links 38 and 44 through circular arc 48 (FIG. 7), locking elbow 43 and bringing auger mast into axial alignment with transport vehicle: control 67 (FIG. 9), actuating frame alignment cylinder 37 (FIG. 7) and control 75 (FIG. 9), actuating frame elevation cylinder 36 (FIG. 7) are employed as required to place auger mast support and positioning frame 74 (FIG. 7) at desired angle of elevation for positioning auger mast. Operator actuates control 68 (FIG. 9), energizing frame extension cylinder 59, to side frame extension 49 (FIG. 7) to necessary length to place auger mast in desired position: engages control 65 (FIG. 9), activating vertical positioning cylinders 33 (FIG. 1), and lifting auger mast 16 (FIG. 1) to desired elevation angle. Operator now makes any minute adjustments with controls as described above to exactly position auger mast 16 at the angular orientation and physical location of hole to be bored. Then operator engages control 63 (FIG. 9), energizing auger actuating cylinder 35 (FIG. 8), extending auger 72, or augers 71 and 72 (FIG. 1), making contact with surface and maintaining continuous pressure on auger: engages control 64 actuating hydraulic motor 8 and bore hole as in operations 1, 2 and 3.

6. Boring Holes Across Obstacles: The driver positions the transport vehicle as near to the obstacle as is practical. The MFE operator, with the power source in operation, activates control 67 (FIG. 9), energizing frame alignment cylinders 37, (FIG. 7), engaging pivot 39, rotating links 38 and 44, through circular arc 48 (FIG. 7): activates control 65 (FIG. 9), energizing vertical positioning cylinders 33 (FIG. 1), to lift auger 72 (FIG. 1); and engages control 75 (FIG. 9), energizing the frame elevation cylinders 36 (FIG. 7), as required, to get elevation clearance of obstacle. Operator engages control 68 (FIG. 9), energizing frame extension cylinder 59 (FIG. 7), sliding frame extension 49 (FIG. 7), and extending auger mast 16 across obstacle. If necessary, the driver carefully moves the vehicle closer to the obstacle. When the auger mast is across the obstacle, operator actuates controls 61 and 62, deploying hydraulic outrigger supports 69, stabilizing vehicle and MFE: activates control 65, energizing vertical positioning cylinders 33, rotating auger mast 16 to the desired angle for boring: engages control 63, energizing auger actuating cylinder 35, extending the auger to contact ground and maintain continuous pressure on it: engages control 64 energizing hydraulic motor 8 and boring holes as in operations 1, 2, 3 and 4, above.

7. Deploying Barrier Scaling Staircase: With auger mast 16 in the travel position, approximately 30 degrees above horizontal, and with the auger removed from the mast, the driver places the transport vehicle at a convenient location near the barrier, with the MFE facing the barrier and perpendicular to it. With power source 20 in operation, the operator engages controls 61 and 62 (FIG. 9), to energize hydraulic outrigger supports 69 (FIGS. 8 and 10)), positioning them as required to stabilize the vehicle: engages control 75 (FIG. 9), energizing frame elevation cylinder 36, raising auger mast support and positioning frame 74 (FIG. 7) to desired angle of elevation: engages control 65 (FIG. 9), activating vertical positioning cylinders 33 to raise auger mast 16 (FIG. 1), and align it with frame 74. Operator activates control 68 (FIG. 9), energizing frame extension cylinder 59, and sliding frame extension 49, moving auger mast crown 23 into supportive contact with breastwork of barrier. Operator now engages frame stair step control 81, activating stair step cylinders 12, moving stair step actuating rod 30, and adjusting stair steps 31 on frame to proper angle for use: engages mast stair step control 73, activating stair step cylinder 12, moving actuating rod 30, and adjusting stair steps 31 on mast to proper angle for use. Scaling staircase 76 (FIG. 10) is now deployed and ready for use.

8. Adjusting the MFE to Compact Form For Travel Through Restricted Clearance Areas: With the auger mast 16 in travel position, approximately 30 degrees above horizontal, and with power source 20 running, operator engages control 67, energizing frame alignment cylinders, and lowering auger mast 16 to the horizontal position over the top of the transport vehicle 77. This is the smallest cross-sectional area configuration of the MFE and permits passage through tight areas.

I claim:

1. A mobile apparatus for rapidly and efficiently excavating foxholes under combat conditions to establish defense perimeters employing a self-contained boring mechanism mounted on a standard transport vehicle, said boring apparatus including in combination:

an operating power source;

a translating auger;

an auger mast on which said translating auger is mounted;

an auger mast support and positioning frame for said auger mast;

means coupled with said power source for adjusting and positioning said support and positioning frame for horizontal plane adjustments;

means on said support and positioning frame for adjusting and positioning aid auger mast in vertical and lateral planes;

a pivot guide plate and link assembly on said support and positioning frame with said plate having a slot therein with a predetermined width and formed as a segment of a circular arc, for guidance control and limitation of motion, said slot functioning to stop travel of said means for adjusting and positioning said auger mast in the vertical and lateral planes;

an articulating link captured by a guide pin in the slot in said plate, and coupled with said means for adjusting and positioning said auger mast to significantly resist motion of said means for adjusting and positioning said auger mast normal to said plate while providing smooth motion of said means for adjusting and positioning said auger mast within the slot in said plate, while simultaneously reducing vibration amplitude.

2. The combination according to claim 1, further including adjusting and positioning control means which permit boring holes at any angle between the vertical downward direction and the horizontal.

3. The combination according to claim 2 wherein said adjusting and positioning control means permits boring holes at any angle between the horizontal and the near-vertical upward direction.

4. The combination according to claim 2 wherein said adjusting and positioning control means permits boring holes at any desired angle to create concealed and unexpected ambush positions for offensive operations.

5. The combination according to claim 2 wherein said adjusting and positioning control means permits positioning the auger mast across barriers, such as walls, to bore holes, whereby the hole is bored on one side while the transport vehicle remains on the other side.

6. The combination according to claim 2 wherein said adjustment and positioning control means compacts said self-mechanism to permit passage of said mechanism through restricted clearance passageways and terrain.

7. The combination according to claim 1, wherein said auger consists of a main foxhole auger with varying diameter cutters, in a stepped configuration, for creating a hole with a stepped bottom, sloping to center, and a small diameter auger, centered on, and attached to, the main auger and preceding it in boring operations, said auger creating an improved foxhole, with an inwardly sloping floor and having a centrally located explosion containment shaft.

8. The combination according to claim 1 further including staircase means mounted integrally on said auger mast, said staircase means having a plurality of individual stair steps which are pivoted to a first retracted position to form a cover over the auger mast during transport and drilling operations; and means coupled with said staircase means for selectively extending said steps from the retracted position to an extended position to form a stairway supported by said auger mast.

9. The combination according to claim 1 wherein said operating power source comprises a hydraulic motor and wherein said means for adjusting and positioning said frame and said auger mast comprises hydraulic cylinders.

10. The combination according to claim 9 further including an internal combustion engine power source coupled to said hydraulic motor to supply power to said hydraulic motor.

11. The combination according to claim 1 further including a control console with controls thereon for operating said power source, each of said adjusting and positioning means, and said auger.

* * * * *